US006845723B2

(12) United States Patent
Kottman et al.

(10) Patent No.: US 6,845,723 B2
(45) Date of Patent: Jan. 25, 2005

(54) FOLDING AND TILTING TABLE

(75) Inventors: Mark A. Kottman, Muscatine, IA (US); Josiah M. Ives, Kalona, IA (US); Mark Schaefers, Muscatine, IA (US); William C. Cesaroni, Glenview, IL (US); Shawn O. Barrett, Des Plaines, IL (US); Robert J. Glenn, II, Chicago, IL (US)

(73) Assignee: HON Technology Inc., Muscatine, IA (US)

( * ) Notice: Subject to any disclaimer, the term of this patent is extended or adjusted under 35 U.S.C. 154(b) by 142 days.

(21) Appl. No.: 10/284,678

(22) Filed: Oct. 31, 2002

(65) Prior Publication Data

US 2004/0083932 A1 May 6, 2004

(51) Int. Cl.[7] ..... A47B 3/00

(52) U.S. Cl. ..... 108/132; 108/133; 108/115; 248/439; 248/188.4

(58) Field of Search ..... 108/124, 127, 108/131–134, 160, 115, 50.01, 50; 248/188.8, 188.6, 188, 188.1, 166, 434, 439, 440

(56) References Cited

U.S. PATENT DOCUMENTS

| | | | | |
|---|---|---|---|---|
| ,148,611 | A | | 3/1874 | Horton |
| ,960,281 | A | | 6/1910 | De Moss |
| 1,918,003 | A | | 7/1933 | Taylor et al. |
| 1,924,945 | A | | 8/1933 | Klotz |
| 2,474,450 | A | | 6/1949 | Woodruff |
| 2,572,474 | A | | 10/1951 | Hamilton |
| 2,686,094 | A | | 8/1954 | Terry |
| 2,795,891 | A | | 6/1957 | Bishop |
| 2,887,348 | A | | 5/1959 | Sadowsky |
| 2,893,803 | A | | 7/1959 | Zivi |
| 3,108,550 | A | | 10/1963 | Knoblock |
| 3,147,606 | A | | 9/1964 | Holmberg |
| 3,166,029 | A | | 1/1965 | Action |
| 3,188,158 | A | | 6/1965 | Sanchez |
| 3,364,884 | A | | 1/1968 | Hamilton et al. |
| 3,401,653 | A | | 9/1968 | Knoblock |
| 3,604,372 | A | | 9/1971 | Hewett et al. |
| 3,606,846 | A | | 9/1971 | Andrews et al. |
| 3,630,156 | A | | 12/1971 | Woodruff |
| 3,796,169 | A | | 3/1974 | Bales et al. |
| 3,818,844 | A | * | 6/1974 | Burr ..... 108/132 |
| 4,105,271 | A | | 8/1978 | Sebel et al. |
| 4,180,002 | A | | 12/1979 | Huempfner |
| 4,196,675 | A | | 4/1980 | Cook |
| 4,879,954 | A | | 11/1989 | Sawamura et al. |
| 4,986,195 | A | * | 1/1991 | Diffrient ..... 248/188.6 |
| 5,205,223 | A | * | 4/1993 | Ball et al. ..... 108/124 |
| 5,337,657 | A | * | 8/1994 | Diffrient ..... 108/115 |
| 5,419,525 | A | | 5/1995 | Hilton |
| 5,490,467 | A | | 2/1996 | Diffrient |
| 5,638,761 | A | | 6/1997 | Berkowitz et al. |
| 5,927,214 | A | * | 7/1999 | Schwartz et al. ..... 108/115 |
| 6,003,447 | A | * | 12/1999 | Cox et al. ..... 108/132 |
| 6,336,414 | B1 | * | 1/2002 | Stewart et al. ..... 108/115 |
| 6,401,631 | B1 | * | 6/2002 | Kane et al. ..... 108/127 |
| 6,637,352 | B1 | * | 10/2003 | Thode et al. ..... 108/132 |
| 6,647,900 | B1 | * | 11/2003 | Kopish ..... 108/115 |

FOREIGN PATENT DOCUMENTS

| | | | |
|---|---|---|---|
| JP | 2000060646 | * | 2/2000 |

* cited by examiner

*Primary Examiner*—Lanna Mai
*Assistant Examiner*—Hahn V. Tran
(74) *Attorney, Agent, or Firm*—Ronald A. Sandler; Jones Day

(57) ABSTRACT

A folding and tilting table which is versatile, simply constructed and easy to use. The table includes a table top, an elongated support member, two leg assemblies pivotally mounted to ends of the support member, a set of wheels connected to the leg assemblies and an elongated hinge connected to the support member and to the table top. A first pair of latch assemblies restrain the table top to the support member and a second pair of latch assemblies restrain the leg assemblies. Once released, the table top may rotate from an in-use horizontal position to a vertical position for storage. Also once released, the leg assemblies may move from the use mode to storage mode quickly and easily.

28 Claims, 11 Drawing Sheets

FOLDING AND TILTING TABLE

BACKGROUND OF THE INVENTION

1. Field of the Invention

The present invention relates to a folding and tilting table and more particularly to a wheeled, folding and tilting office table which features versatility, simplicity and reliability.

2. Description of the Related Art

Office furniture has changed greatly in the last ten years to reflect a more casual atmosphere and also a new workplace philosophy of communication. Furthermore, office space has become more versatile to allow different space arrangements to be made as needed and on little or no notice.

BRIEF SUMMARY OF THE INVENTION

The present invention conforms with the new philosophy and provides a versatile, simple yet reliable work table. What is described here is a table having folding legs and a tiltable top including a table top having a length, a support structure for supporting the table top, the support structure including a support member and a pair of folding leg assemblies, a hinge connected to the support member and to the table top for allowing the table top to rotate from a horizontal position where it is resting on the support member to a vertical position for table storage, the support member being centrally located relative to the table top and extending parallel to the length of the table top, each of the pair of leg assemblies being pivotally mounted to the support member and movable between extended and folded positions where, in the extended position, the table is in use mode and in the folded position, the table is in storage mode, a first latch assembly mounted to a bottom of the table top and movable with the table top for restraining the table top in the horizontal position, and a second latch assembly mounted to the support member for restraining at least one of the leg assemblies in the extended position.

There are a number of advantages, features and objects achieved with the present invention which are believed not to be available in earlier related devices. For example, one advantage is that the present invention provides for a versatile table that may be altered and easily placed out of the way or stored and yet reactivated easily and quickly. Another couple of objects of the present invention is the provision of a work table that is simply constructed and operationally reliable. A further advantage of the present invention is that the table may be stored in a folded position or in a tilted position. Another feature of the present invention is the provision of a work table that is easily moved about, both to facilitate storage and to facilitate use.

A more complete understanding of the present invention and other objects, advantages and features thereof will be gained from a consideration of the following description of preferred embodiments read in conjunction with the accompanying drawing provided herein. The preferred embodiments represent examples of the invention which are described here in compliance with Title 35 U.S.C. section 112 (first paragraph), but the invention itself is defined by the attached claims.

Figure 1:
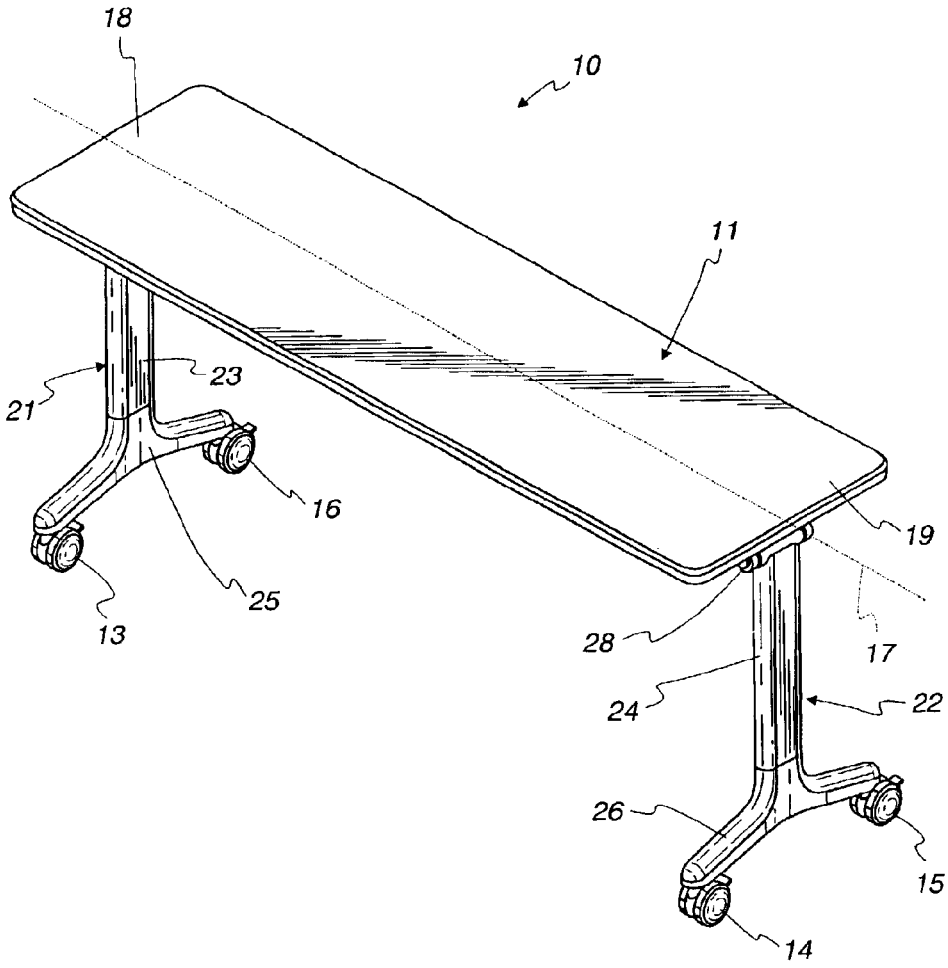
FIG. 1 is a downwardly looking isometric view of a folding and tilting table having a table top and two leg assemblies.

DETAILED DESCRIPTION OF A PREFERRED EMBODIMENT AND VARIATION EMBODIMENTS OF THE INVENTION

While the present invention is open to various modifications and alternative constructions, the preferred embodiments shown in the various figures of the drawing will be described herein in detail. It is understood, however, that there is no intention to limit the invention to the particular embodiments, forms or examples disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Figure 2:
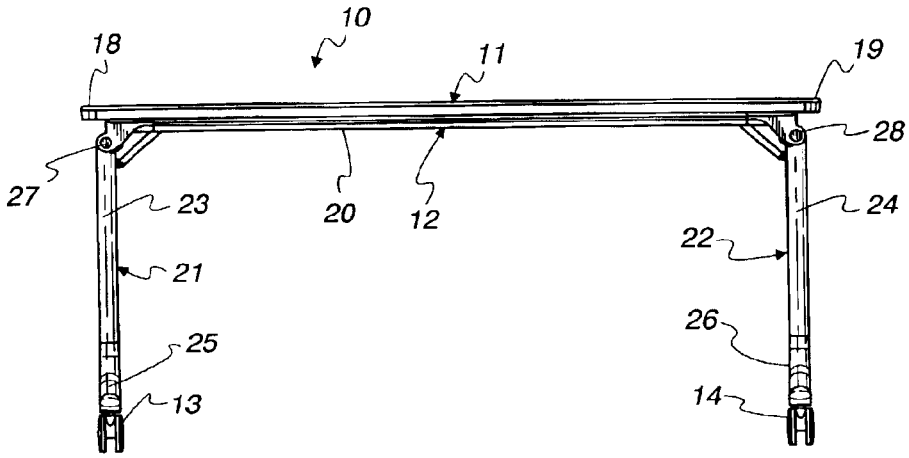
FIG. 2 is a front elevation view of the table shown in FIG. 1.
Figure 3:
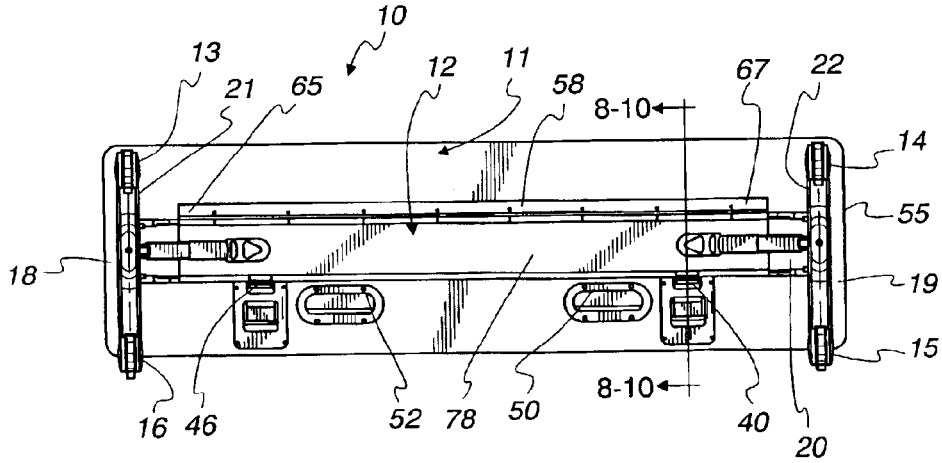
FIG. 3 is a bottom plan view of the table shown in FIGS. 1 and 2 and also illustrating a support member.

Referring to FIGS. 1–3, there is illustrated a preferred folding and tilting office or work table 10 set up in a position where it may be used in an office environment as a work table, a conference table, a computer table and the like. The table includes a table top 11, a support structure 12, and four wheel assemblies 13, 14, 15, 16. The table top has a generally rectangular shape in plan view with a length parallel to a central longitudinal axis represented by a broken line 17. The table top includes a left end portion 18 and a right end portion 19.

The support structure 12 includes a support member 20 and a pair of folding leg assemblies 21, 22. The support structure provides a strong, rigid and robust mounting for the table top 11 while also allowing for quick and easy folding of the leg assemblies. Alternately, the table top may be tilted as will be explained below. In the in-use or work mode position as shown in FIGS. 1–3, the table may be easily moved for purposes of work versatility and when in a tilt storage mode, the table can also be easily moved.

The support member 20 is elongated and tubular shaped and extends substantially of the length of the table top from the left end portion 18 to the opposite end portion 19. The leg assemblies each include a stem portion 23, 24, a foot portion 25, 26 and a pivot portion 27, 28. The pivot portion will be described in more detail below.

It is to be noted that in the figures, the same numbers will designate the same or very similar parts of the several embodiments disclosed.

Figure 4:
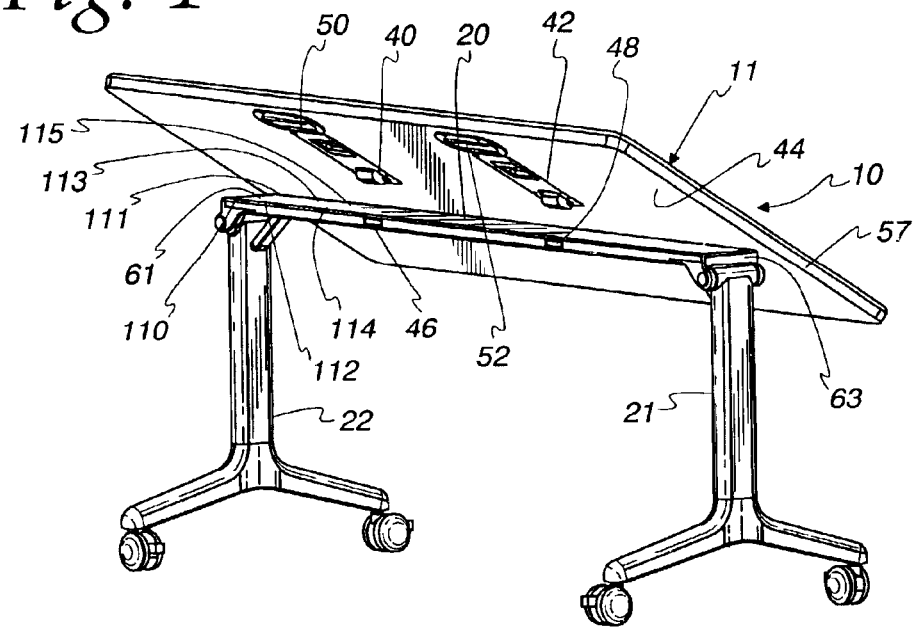
FIG. 4 is an isometric view illustrating the table top of a variation table in a partially rotated position.
Figure 5:
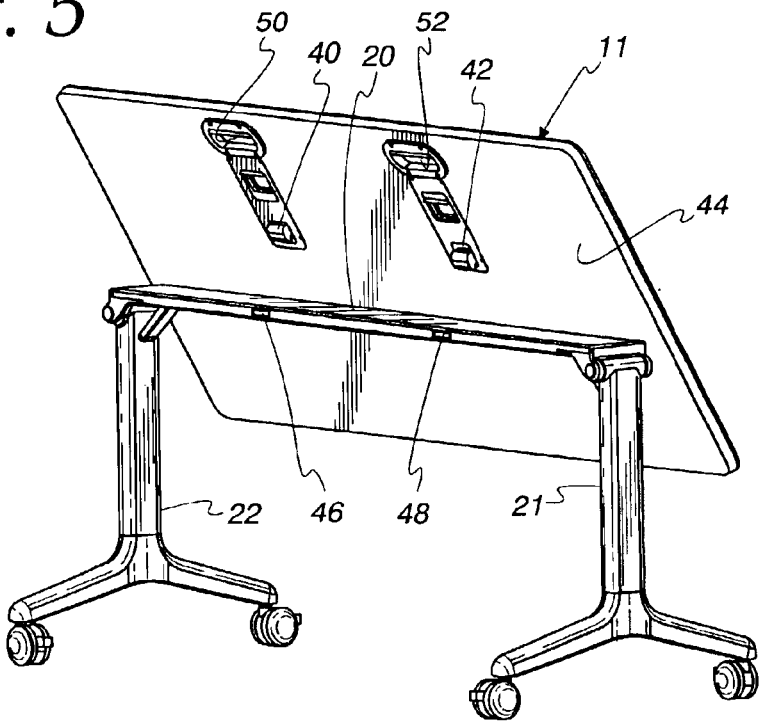
FIG. 5 is an isometric view illustrating the table shown in FIG. 4 with the table top being further rotated from the position shown in FIG. 4.
Figure 6:
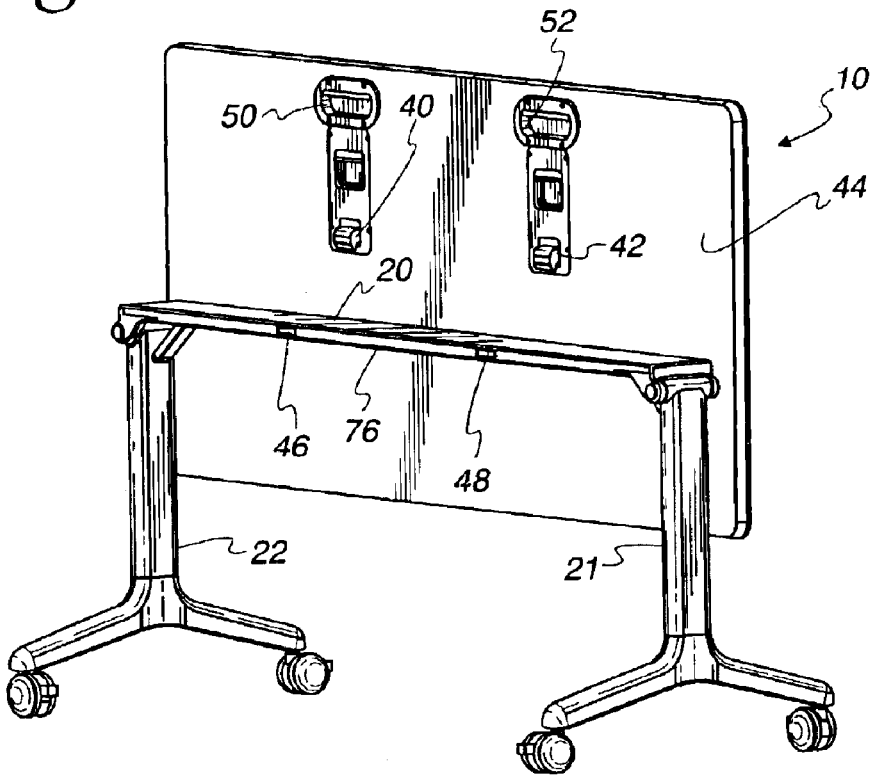
FIG. 6 is an isometric view of the table shown in FIGS. 4 and 5 with the table top in a vertical position after being fully rotated.

The tilting feature of the table 10 is shown graphically in FIGS. 4–6 by referring to a modified table. As can be seen, the table top 11 is able to rotate from a horizontal position shown in FIG. 2 to a vertical position shown in FIG. 6, with partial rotational positions illustrated in FIGS. 4 and 5. In FIG. 4, the table top is shown at approximately thirty degrees from a horizontal reference and in FIG. 5, the table top is shown at approximately sixty degrees from the horizontal reference. Also illustrated are two latch assemblies 40, 42 which are embedded or recessed in a bottom 44 of the table top 11. Two latch openings 46, 48 are formed in the support member 20. It is to be noted that the two latch assemblies 40, 42 are referred to as a first latch assembly in claim 1. It is also to be noted that the support member in the preferred embodiment, FIGS. 1–3, does not have the latch openings 46, 48.

Also embedded in the bottom of the table top are two handles 50, 52. The handles facilitate tipping the table to expose the leg assemblies so as to allow the leg assemblies to be folded. In the preferred embodiment shown in FIGS. 1–3, the handles 50, 52 are inboard of the latch assemblies. In the embodiment shown in FIGS. 4–6, the handles 50, 52 are between the latch assemblies 40, 42 and a curved table top peripheral edge 57 because the width of the table embodiment shown in FIGS. 4–6 is greater than the width of the table embodiment shown in FIGS. 1–3.

Openings may be formed in the table top (not shown) to facilitate the placement of electrical or data cables and the like.

Figure 7:
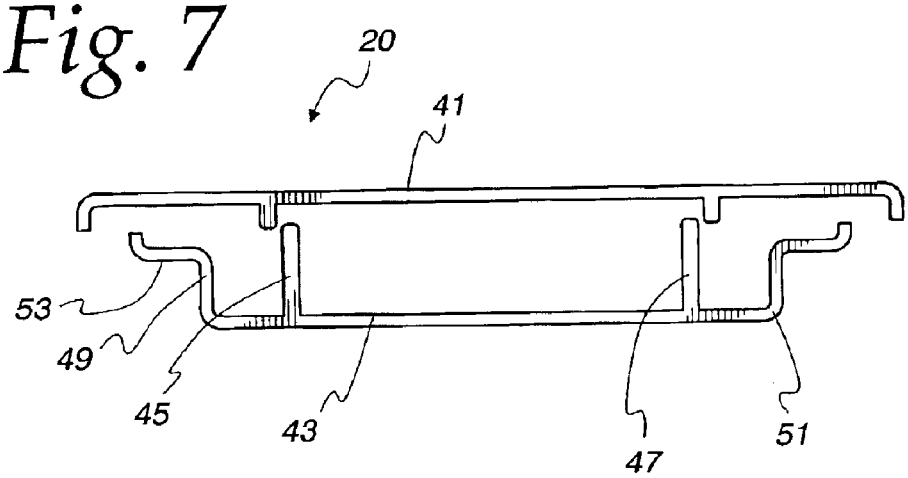
FIG. 7 is an elevation view of the support member.

The support member 20 is shown more clearly in FIG. 7 in a side view. The support member is formed of aluminum and includes a top support wall 41, a bottom wall 43, two inner walls 45, 47 and two irregular shaped outer walls 49, 51. The construction makes the support member very strong but relatively light weight. As will be explained below, a portion of the leg assembly is received by an inner box structure formed by the top and bottom walls 41, 43 and the inner walls 45, 47. The outer walls form ledges 53, 55, which may be used to engage the latch assemblies when the table top is horizontally positioned in a use mode.

Figure 8:
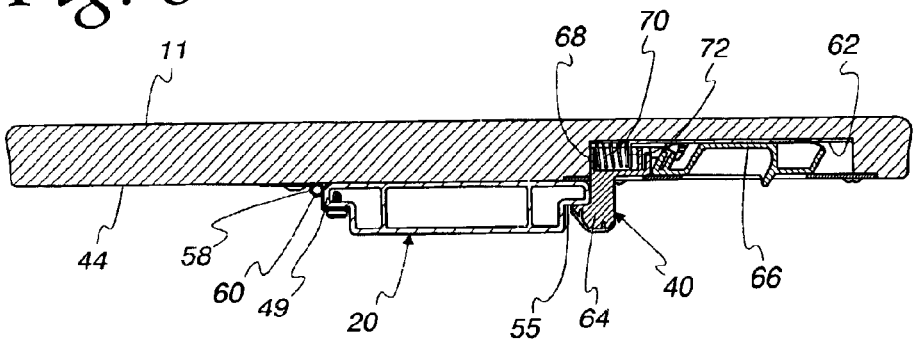
FIG. 8 is a diagrammatic sectional elevation view of the table top of the table shown in FIGS. 1–3, illustrating a hinge, the support member and a latch assembly where the table top is in a horizontal position and restrained, the view bring taken along line "8–10"-"8–10".
Figure 9:
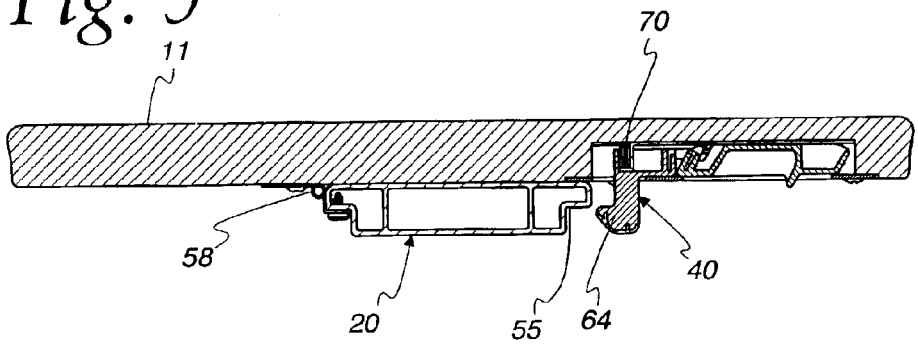
FIG. 9 is similar to the view in FIG. 8, however, the latch assembly has been disengaged from the support member.
Figure 10:
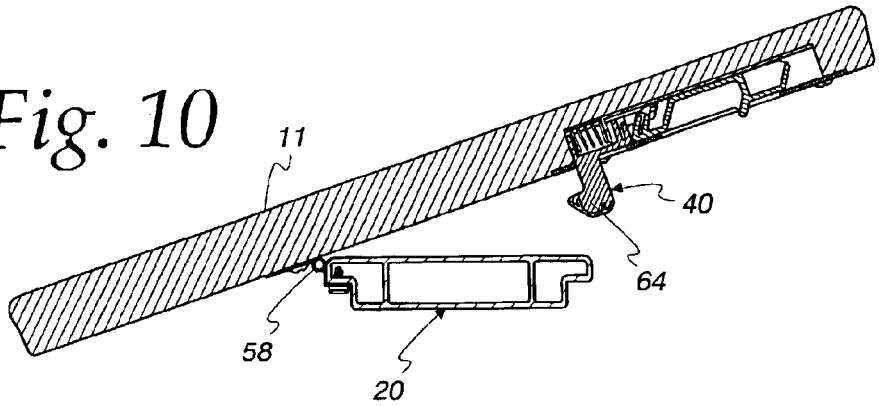
FIG. 10 is a view similar to that shown in FIGS. 8 and 9, however the table top is shown as it begins rotation away from the horizontal position shown in FIGS. 8 and 9 toward a vertical position, such as shown in FIG. 6.

The tilt latching operation is illustrated in diagrammatic form in FIGS. 8–10. The support member 20 is illustrated in section view where it is seen as supporting the table top 11, FIG. 8. The table top is connected to the support member by an elongated hinge 58 which is connected to the left side wall 49 of the support member 20 and to the bottom 44 of the table top as most clearly seen in FIGS. 3 and 8. In the arrangement shown in FIGS. 8–10, the table top is capable of rotating or tilting in a counterclockwise direction about an axis 60 of the hinge. The hinge may extend substantially the length of the support member and the table top. The support member (and attached leg assemblies) include end portions 61, 63, FIG. 4, and the hinge includes end portions 65, 67, FIG. 3.

The latch assembly 40 is shown embedded in a recess 62 in the bottom of the table top and includes a hook or catch portion 64, a handle portion 66 and an abutment portion 68. A spring 70 is mounted between the abutment portion 68 and a wall 72 in the recess 62.

The hook portion 64 of the latch assembly slides under the ledge 55 of the support member so that a restraining or locking engagement exists between the latch assembly and the support member as shown in FIG. 8. When the latch is moved to the right as shown in FIG. 9, the spring 70 is compressed allowing the latch hook portion to disengage from the support member. When this occurs, the table top may be lifted and rotated in a counterclockwise direction as shown in FIG. 10.

Once the table top reaches its vertical position as shown in FIG. 6, the table may easily be moved out of the way and stored temporarily against a wall, for example. Or, the table may be stored in a closet for the longer term. Furthermore, additional tables may be nested or closely aligned by having the table top of another table placed immediately adjacent exposed support member 20. Each nested table may be offset longitudinally to allow the leg assemblies of one table to avoid interference with the leg assemblies of an adjacent table.

The tilt configuration shown in FIG. 6, allows a number of tables to be quickly, easily and compactly stored for the short or long term and yet be immediately available for use simply by rolling the table to a desired work location and rotating the table top from the vertical position to the horizontal position. Hence, a single conference area may host back to back meetings in which a number of tables may be used in a first meeting, the tables tilted and moved out of the way for a second meeting and then the tables may be brought back and restored to horizontal positions for a third meeting.

Figure 11:
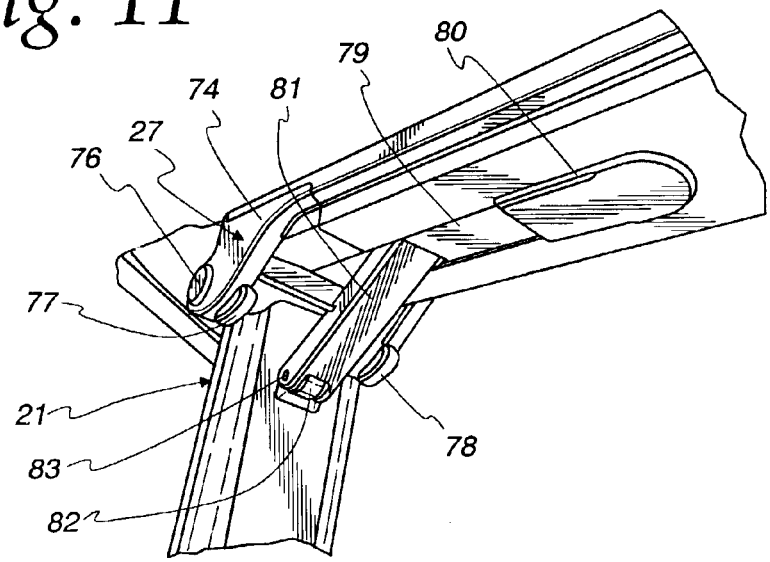
FIG. 11 is an upward looking isometric view of a portion of a folding leg assembly and the support member.
Figure 12:
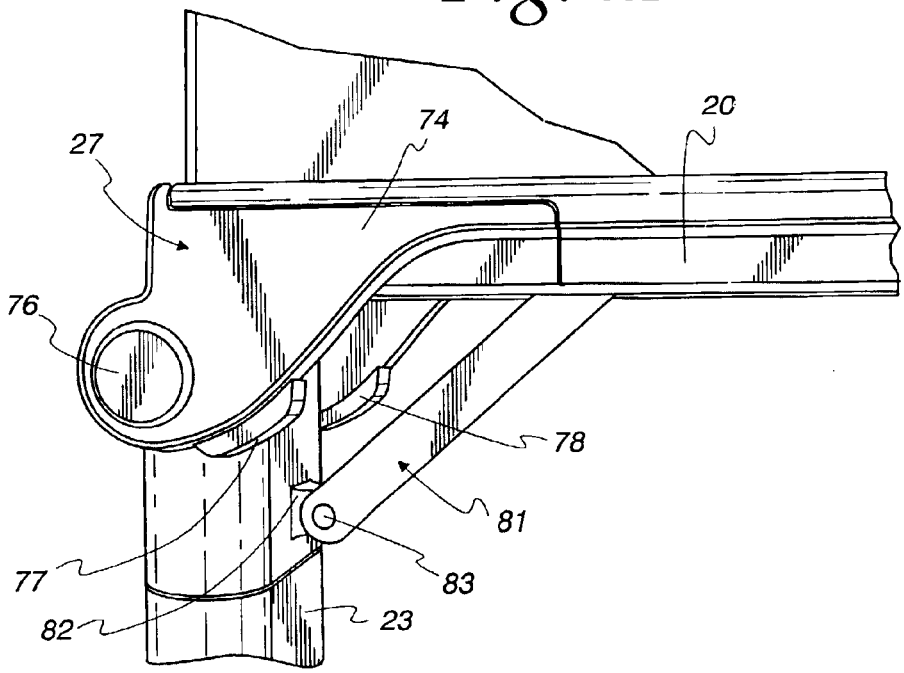
FIG. 12 is an elevation view of the leg assembly shown in FIG. 11.
Figure 13:
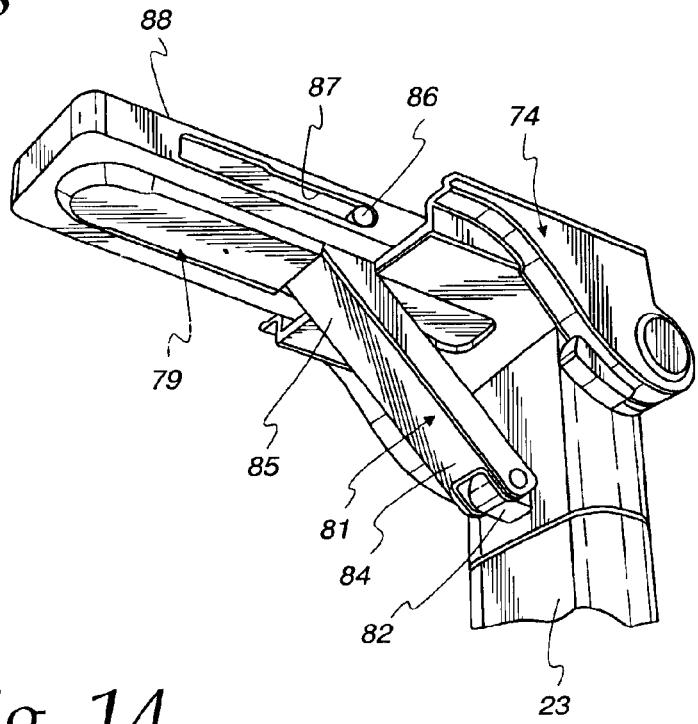
FIG. 13 is an upward looking isometric view of a yoke casting, a brace and a latch assembly, all facing in an opposite direction from the views in FIGS. 11 and 12.
Figure 14:
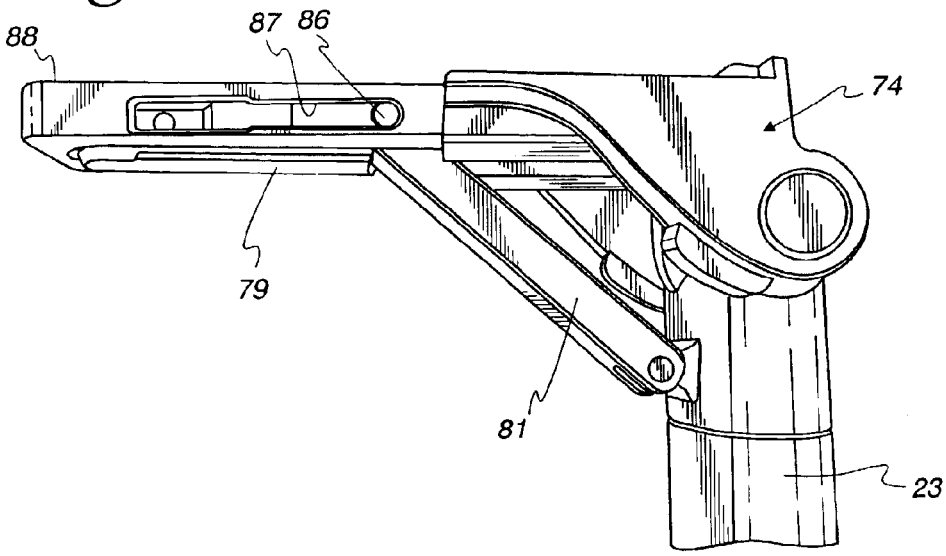
FIG. 14 is an elevation view of elements shown in FIG. 13.
Figure 15:
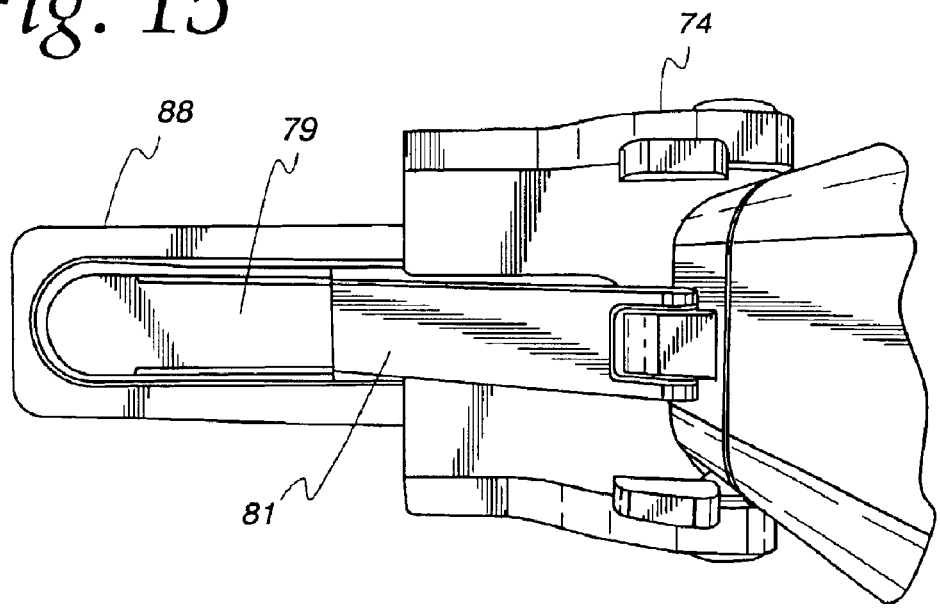
FIG. 15 is a bottom plan view of the elements shown in FIGS. 13 and 14.
Figure 16:
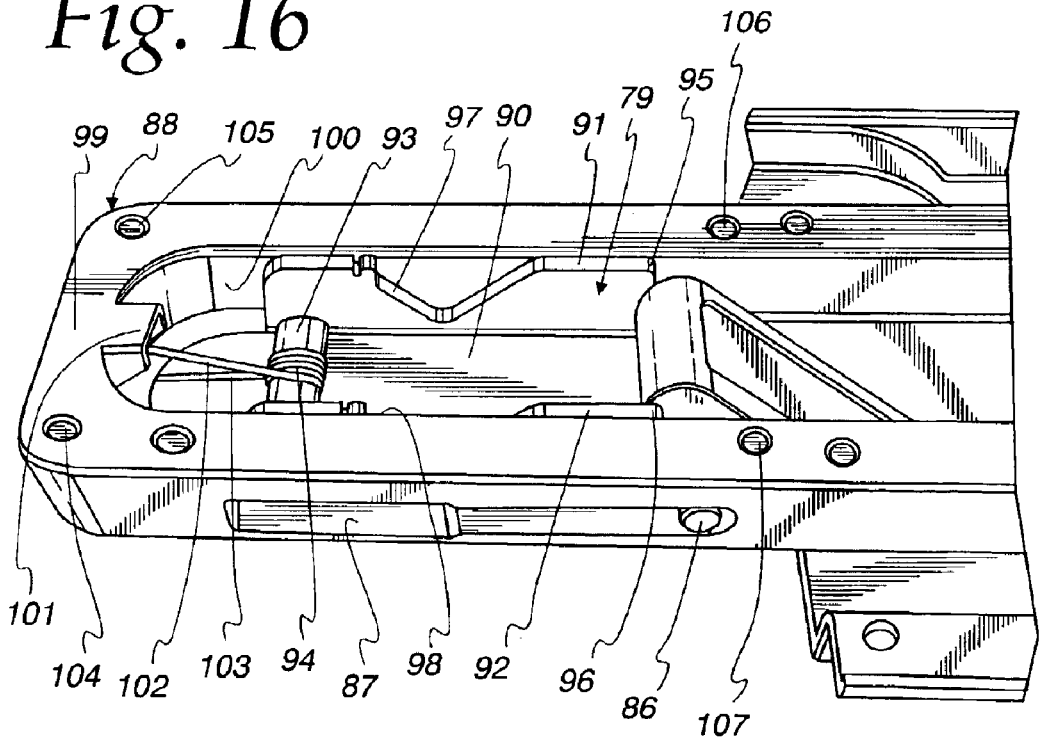
FIG. 16 is a downward looking isometric view of a portion of the elements shown in FIGS. 13–15.

The pivot portion 27 of the leg assembly 21 may be appreciated by reference to FIGS. 11 and 12. The pivot portion includes a yoke casting 74 pivotally connected at one end portion 73 to the leg stem 23 by a pivot pin 75, FIG. 17. A resilient bumper cover 76 covers the pivot pin and also protects the table top of an adjacent table when the tables are nested. Two additional resilient bumps 77, 78 are provided for protecting the table tops when the tables are stacked in folded storage as explained below. A second latch assembly 79 is visible as is a sliding cover 80 for a portion of the latch assembly. Between the latch assembly and the leg stem is a channel shaped brace 81 pivotally mounted to a lug 82 with a pivot pin 83.

Referring now to FIGS. 13–16, more detail is disclosed. The brace 81 is connected at a lower end portion 84 to the lug 82. The upper end portion 85 engages the latch assembly 79 with a sliding pin 86. The sliding pin is confined to slide in a slot 87 formed in a tongue or second end portion 88 of the yoke casting 74.

The latch assembly includes a latch having a somewhat U-shape with an actuator wall 90, two cam arms 91, 92, a pivot shaft 93 and a torsion spring 94. The cam arms include a head portion 95, 96, and a groove portion 97, 98.

The tongue portion of the yoke casting is a loop of metal with a frame 99, a central opening 100 and the oppositely formed slots 87. The frame also includes a spring tab 101 for receiving one end 102 of the torsion spring 94 while the other end 103 bears against the actuator wall 90 of the latch assembly. The frame also includes six screw receiving openings, of which only four openings 104, 105, 106, 107 are shown.

The tongue portion 88 of the pivot portion of the leg assembly slides into the space or box formed in the support member and six screws 110, 111, 112, 113, 114, 115, FIG. 3, may be used to fasten the leg assembly to the support member.

Figure 17:
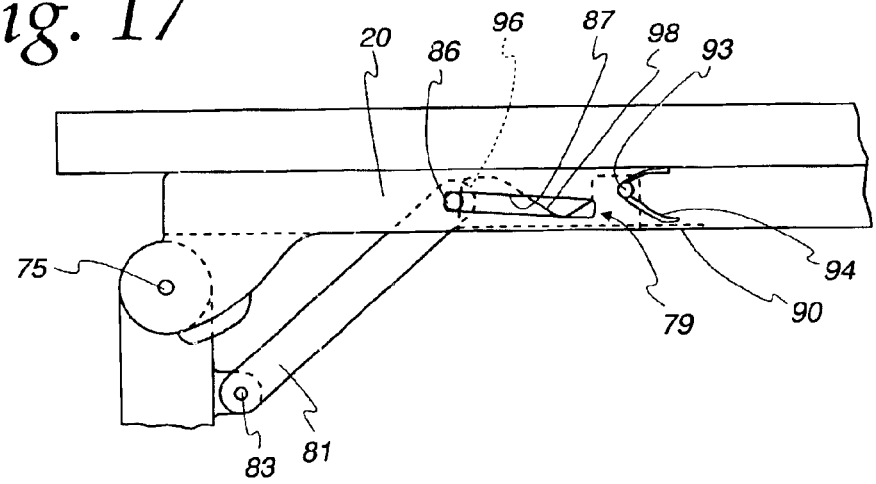
FIG. 17 is a diagrammatic elevation view of the leg assembly shown in FIGS. 11 and 12 with the leg assembly in an extended position.
Figure 18:
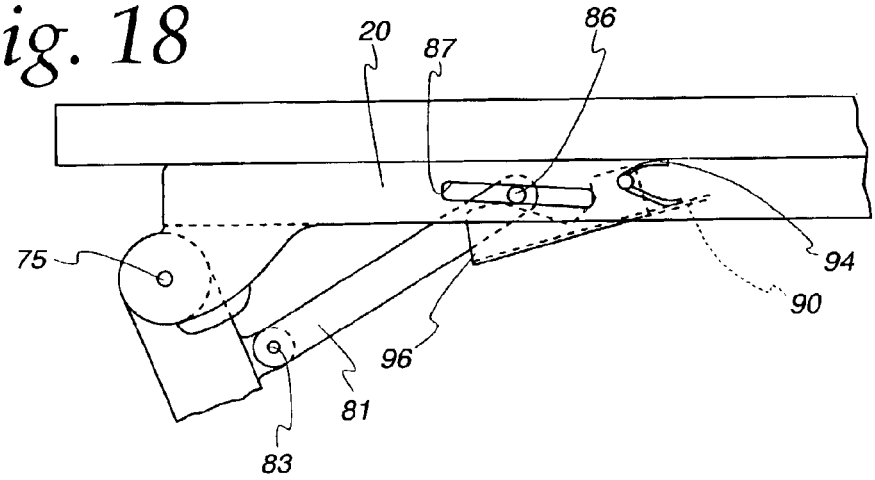
FIG. 18 is a diagrammatic elevation view illustrating the leg assembly, shown in FIG. 17, in a pivoted position.
Figure 19:
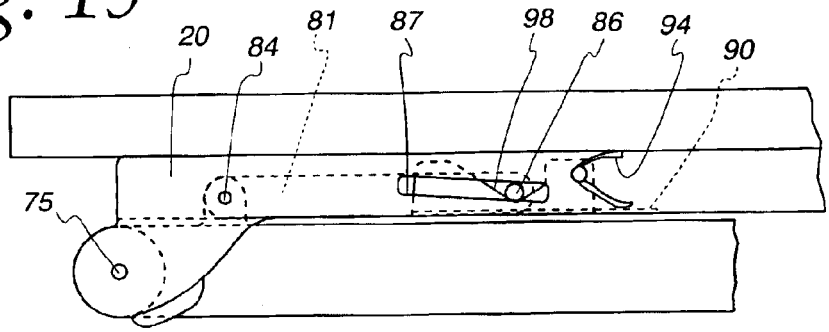
FIG. 19 is similar to the views shown in FIGS. 17 and 18 but shows the leg assembly in a fully folded position.
Figure 20:
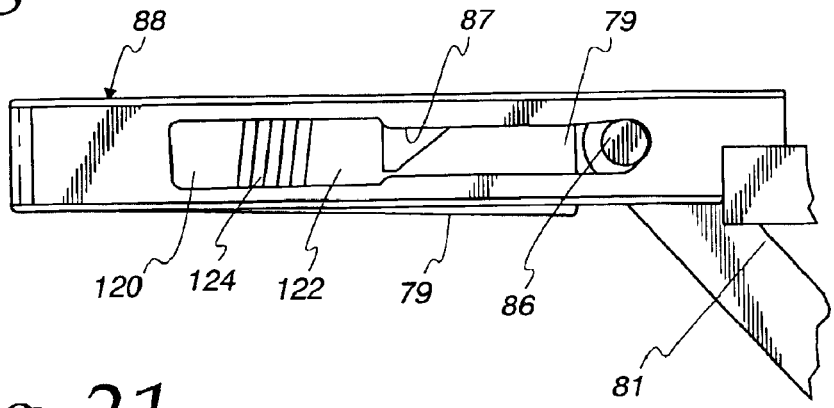
FIG. 20 is an elevation view of a portion of the yoke casting, the brace, the latch assembly and a brace pin showing the pin in position when a leg is fully extended.
Figure 21:
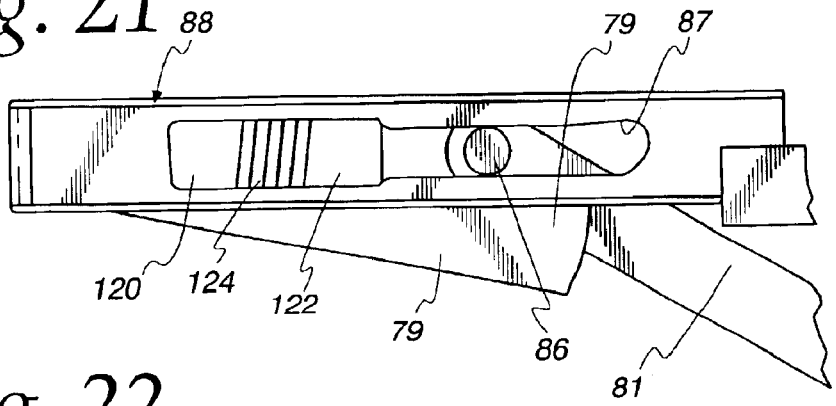
FIG. 21 is an elevation view similar to that shown in FIG. 20 but with the leg partially folded.

The operation of the latch assembly is best shown in FIGS. 17–19. The leg assembly is pivoted about the pin/axis 75. The leg assembly is connected to the brace 81, which in turn is pivoted around the pivot pin 83. At the opposite end of the brace is the pin 86 which moves in the slot 87 formed in the yoke casting. The latch assembly 79 pivots around an axis coincident with the shaft 93 so that when the leg assembly is extended as shown in FIG. 17, the head portion 96 of the latch assembly abuts the pin 86 and prevents rightward movement. The head portion is maintained in position by the torsion spring 94 positioned between the support member and the actuator wall 90. When the latch is pivoted around the axis/shaft 93, the leg assembly may be pivoted around the axis/pin 75 thereby allowing the brace pin 86 to move along the slot 87 to the right as shown in FIG. 18 and along the latch cam arms 91, 92 which follow the pin. When the leg assembly is fully folded as shown in FIG. 19, the pin 86 rests within a depression of the groove portion 98 of the arms. This arrangement restrains the pin, both when the leg assembly is in the extended position (by the latch head portion) and again when the leg assembly is in the folded position (by the latch groove portion).

Figure 22:
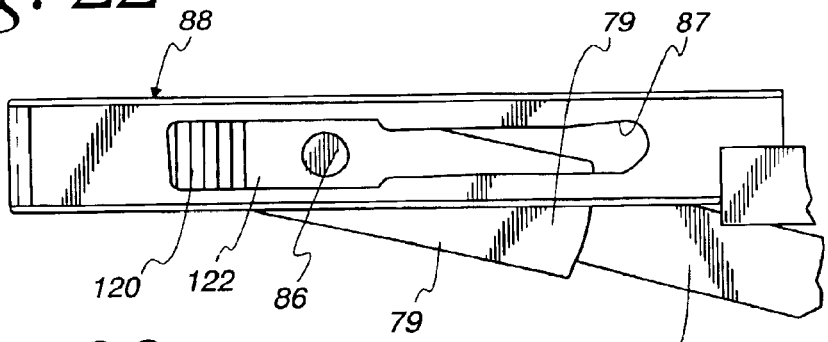
FIG. 22 is an elevation view similar to that shown in FIGS. 20 and 21 but with the pin at about the end of travel to the left.
Figure 23:
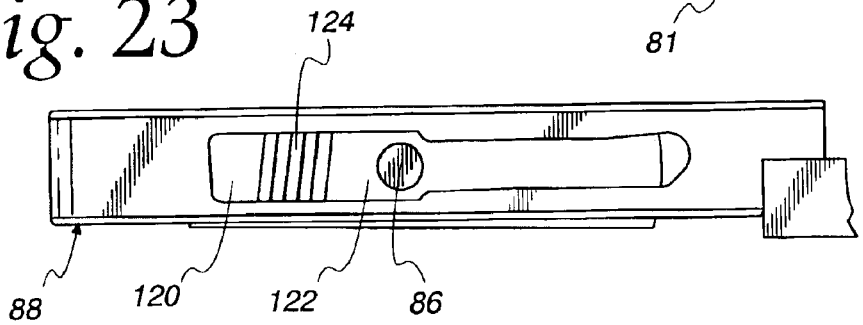
FIG. 23 is an elevation view similar to that shown in FIGS. 20–22 but with the pin in a position to restrain the leg in a folded position.

Referring now to FIGS. 20–23, additional hardware is shown attached to the tongue portion of the yoke casting. Four spring cups, of which only the cups 120, 122 are shown, are placed in the slots 87 and the cups seat two coil springs of which only one spring 24 is shown. The cups/spring combination comes into contact with the brace pin 86 as the pin slides leftward when the leg assembly pivots from an extended to a folded position, FIGS. 20–22. When the pin moves leftward, it compresses the spring as shown in FIG. 22 so that when fully folded, as shown in FIG. 23, the spring biases the pin against the latch groove portion to restrain the leg assembly in the folded position. However, the restraint can be easily overcome when the leg assembly is pulled away from the support member as it would be during the extending operation.

Figure 24:
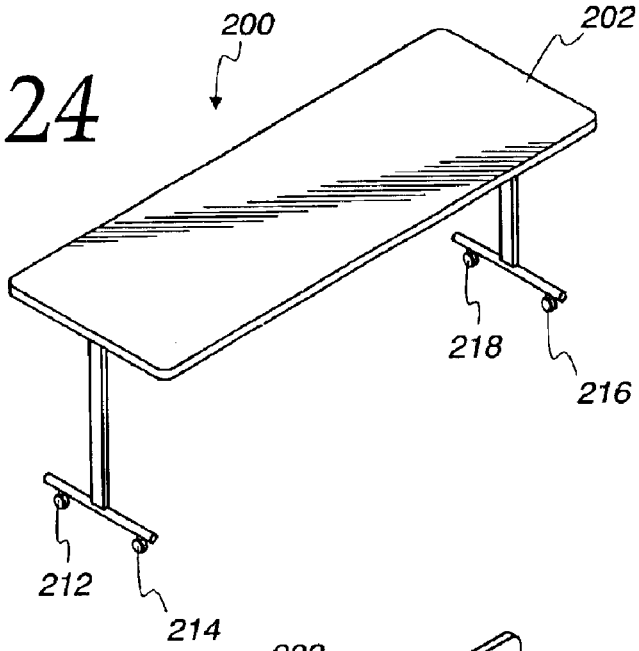
FIG. 24 is a diagrammatic view illustrating a modified table in a fully extended work mode position.
Figure 25:
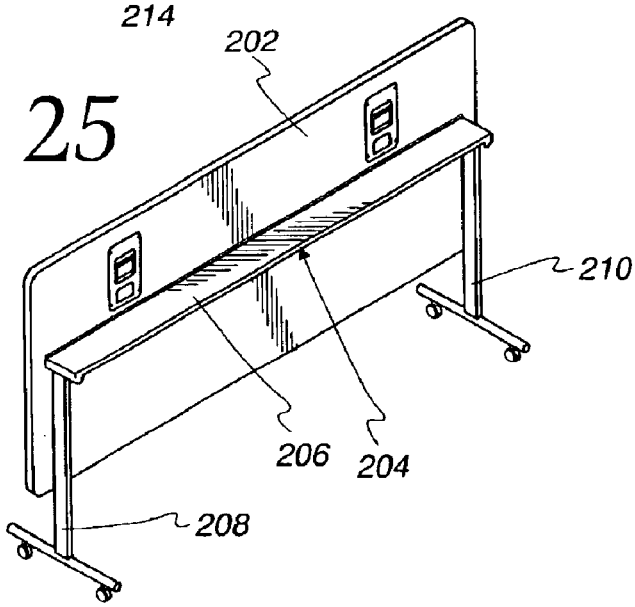
FIG. 25 illustrates the table shown in FIG. 24 in a fully tilted or rotated position to allow the table to be stored in an out of the way location or in an aligned nested arrangement with other tilted tables.
Figure 26:
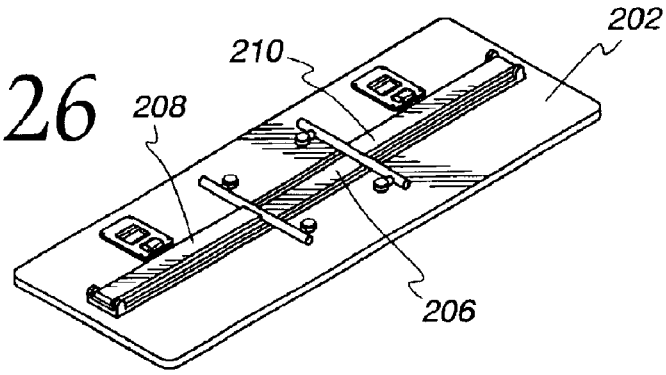
FIG. 26 illustrates the table shown in FIGS. 24 and 25 in a fully folded position allowing storage in a stacked arrangement.

Yet another variation of the table is shown graphically in FIGS. 24–26. The table 200 includes a table top 202 and a support structure 204. The support structure includes the support member 206 and two leg assemblies 208, 210. The table also includes a set of four wheels 212, 214, 216, 218. In FIG. 24, the table is shown in the use mode, horizontal position. In FIG. 25, the table is shown in one of the storage modes where the table top has been tilted from a horizontal to a vertical position. In FIG. 26, the table is shown in another compact storage mode where the table leg assemblies are folded.

It is to be understood that a table may be constructed so as to tilt only, or fold only, or neither, if desired. In any configuration (except the non-folding, non-tilting model), the table disclosed assumes a compact storage position. For example, the folded mode shown in FIG. 26 allows for stacking multiple tables. This may be desirable for longer term storage. When the table top is tilted to its vertical position, nested storage is facilitated. This may be convenient for short term storage. The use of the disclosed support structure allows the table to be tilted or folded in an efficient, simple and inexpensive manner while reducing the strength requirement of the top attachment. The folding arrangement of the support structure provides for a compact, yet very rigid configuration which is ideal for long term storage. A model which is non-tilting and non-folding does not form part of the claimed invention.

The above specification describes in detail several preferred embodiments of the present invention. Other examples, embodiments, modifications and variations will, under both the literal claim language and the doctrine of equivalents, come within the scope of the invention defined by the appended claims. For example, a different leg assembly design or hinge arrangement are considered equivalent structures and will come within the literal language of the claims. Still other alternatives will also be equivalent as will many new technologies. For example, use of the table at home, in a school or within government offices also are equivalent. There is no desire or intention here to limit in any way the application of the doctrine of equivalents nor to limit or restrict the scope of the invention.

What is claimed is:

1. A table having folding legs and a tiltable top comprising in combination:

a table top having a length;

a support structure for supporting said table top, said support structure including a support member and a pair of folding leg assemblies;

a hinge connected to said support member and to said table top for allowing said table top to rotate about a horizontal axis from a horizontal position, where said table top is resting on said support member, to a vertical position for table storage, said support member being centrally located relative to said table top and extending parallel to the length of said table top;

each of said pair of leg assemblies is pivotally mounted to said support member and each is pivotal about a horizontal axis perpendicular to said first mentioned horizontal axis between extended and folded positions, where in the extended position, the table is in use mode and in the folded position, the table is in storage mode;

a first latch assembly mounted to a bottom of said table top and movable therewith for restraining said table top in said horizontal position; and a second latch assembly mounted to said support member for restraining at least one of said pair of leg assemblies in said extended position.

2. The table as claimed in claim 1 wherein:

said support member is elongated and extends substantially the length of said table top.

3. The table as claimed in claim 1 wherein:

said support member is tubular shaped.

4. The table as claimed in claim 1 wherein:

said hinge is elongated.

5. The table as claimed in claim 1 wherein:

said hinge extends substantially the length of said support member.

6. The table as claimed in claim 1 wherein:

said support member is elongated with opposing end portions; and each of said pair of leg assemblies is pivotally mounted to a respective end portion of said support member.

7. The table as claimed in claim 6 wherein:

said support member is elongated and extends substantially the length of said table top.

8. The table as claimed in claim 7 wherein:

said hinge is elongated and extends substantially the length of said support member.

9. The table as claimed in claim 8 wherein:

said support member is tubular shaped.

10. The table as claimed in claim 6 wherein:

each of said leg assemblies includes a yoke assembly pivotally connected at one end portion to a leg and at an opposite end portion to said second latch assembly, and a brace pivotally connected at one end portion to said leg and at an opposite end portion to said second latch assembly.

11. The table as claimed in claim 10 wherein:

said support member is tubular; and said opposite end portion of said yoke assembly is received by said support member.

12. A table having folding legs and a tiltable top comprising in combination:

a table top having a length;

a support structure for supporting said table top, said support structure including a support member and a pair of folding leg assemblies;

a hinge connected to said support member and to said table top for allowing said table top to rotate from a horizontal position, where said table top is resting on said support relative to said table top and extending parallel to the length of said table top;

each of said pair of leg assemblies is pivotally mounted to said support member and each is movable between extended and folded positions, where in the extended position, the table is in use mode and in the folded position, the table is in storage mode;

a first latch assembly mounted to a bottom of said table top and movable therewith for restraining said table top in said horizontal position; and a second latch assembly mounted to said support member for restraining at least one of said pair of leg assemblies in said extended position, said support member is elongated with opposing end portions;

said support member is elongated with opposing end portions;

each of said pair of leg assemblies is pivotally mounted to a respective end portion of said support member;

each of said leg assemblies includes a yoke assembly pivotally connected at one end portion to a leg and at an opposite end portion to said second latch assembly, and a brace pivotally connected at one end to said leg and at an opposite end portion to said second latch assembly;

said support member is tubular;

said opposite end portion of said yoke assembly is received by said support member;

said opposite end portion of said yoke assembly includes oppositely located slots; and said opposite end portion of said brace includes pins for sliding within said slots.

13. A table having a tilting table top comprising:

a table top;

a centrally located, longitudinally extending support member with opposing end portions;

a pair of leg assemblies, each leg assembly being mounted to an end portion of said support member;

a hinge connected to said support member and to said table top; and a spring biased latch assembly mounted to said table top for engaging said support member wherein when said latch assembly is engaged with said support member, said table is maintained in a horizontal position, and when said latch assembly is disengaged from said support member, said table top is rotatable from said horizontal position to a vertical position, said table top being pivotal about a first horizontal axis and said pair of leg assemblies being pivotal about second and third horizontal axes, the second and third horizontal axes being perpendicular to the first horizontal axis.

14. The table as claimed in claim 13 wherein:

said latch assembly is mounted within a recess in said table top.

15. The table as claimed in claim 14 wherein:

said support member is tubular shaped and extends substantially along a length of said table top.

16. A table having a tilting table top comprising:

a table top;

a centrally located, longitudinally extending support member with opposing end portions;

a pair of leg assemblies, each leg assembly being mounted to an end portion of said support member;

a hinge connected to said support member and to said table top; and a spring biased latch assembly mounted to said table top for engaging said support member wherein when said latch assembly is engaged with said support member, said table is maintained in a horizontal position, and when said latch assembly is disengaged from said support member, said table top is rotatable from said horizontal position to a vertical position;

said latch assembly is mounted within a recess in said table top;

said support member is tubular shaped and extends substantially along a length of said table top; and said latch assembly engages a wall of said tubular shaped support member.

17. The table as claimed in claim 16 wherein:

said pair of leg assemblies are movable between extended and folded positions.

18. The table as claimed in claim 17 wherein:

said latch assembly is mounted within a recess in said table top.

19. A folding table comprising:

a table top having first and second end portions;

a support structure for supporting said table top, said support structure including a support member connected to said table top and a pair of folding leg assemblies;

each of said pair of leg assemblies is pivotally mounted to said support member and each is movable between extended and folded positions, wherein the extended position, the table is in-use mode and in the folded position, the table is in storage mode; and a pair of latch assemblies mounted to said support member, each latch assembly for restraining a leg assembly, said table top being pivotal about a first horizontal axis and said pair of leg assemblies being pivotal about second and third horizontal axes, the second and third horizontal axes being perpendicular to the first horizontal axis.

20. A folding table comprising:

a table top having first and second end portions;

a support structure for supporting said table top, said support structure including a support member connected to said table top and a pair of folding leg assemblies;

each of said pair of leg assemblies is pivotally mounted to said support member and each is movable between extended and folded positions, wherein the extended position, the table is in-use mode and in the folded position, the table is in storage mode; and a pair of latch assemblies mounted to said support member, each latch assembly for restraining a leg assembly, each of said leg assemblies includes a yoke assembly pivotally connected at one end portion to a leg and at an opposite end portion to one of said pair of latch assemblies, a brace pivotally connected at one end portion to said leg and at an opposite end portion to said one of said pair of latch assemblies.

21. The folding table as claimed in claim 20 wherein:

said support member is tubular; and said opposite end portion of said yoke assembly is received by said support member.

22. The folding table as claimed in claim 21 wherein:

said opposite end portion of said yoke assembly includes oppositely located slots; and said opposite end portion of said brace includes pins for sliding within said slots.

23. A table having folding legs and a tiltable top comprising:

a table top;

support member;

a hinge connected to said support member and to said table top, said table top being pivotal around a first horizontal axis from a horizontal position to a generally vertical position for storage;

a pair of leg assemblies mounted to said support member and spaced from said table top, one of said pair of leg assemblies being pivotal around a second horizontal axis which is generally perpendicular to the first horizontal axis and the other of said pair of leg assemblies being pivotal around a third horizontal axis which is generally perpendicular to the first horizontal axis wherein said leg assemblies are pivotal from an extended in-use position to a folded storage position and said table has two storage options, one option for vertical nesting and second option for horizontal or vertical stacking.

24. The table apparatus of claim 23 including:

two spaced apart latch assemblies mounted to said table top for engaging said support member to maintain said table top in a horizontal non-pivoted position.

25. The table apparatus of claim 24 wherein:

said latch assemblies are each mounted in table top.

26. The table apparatus of claim 25 wherein:

said latch assemblies are each latched to said support member when leg assemblies are folded.

27. The table apparatus of claim 23 including:

a pair of handles mounted to said table top.

28. The table apparatus of claim 27 wherein:

said pair of handles are mounted to a bottom surface of table top.

* * * * *